US009991626B2

(12) United States Patent
Takeshita et al.

(10) Patent No.: US 9,991,626 B2
(45) Date of Patent: Jun. 5, 2018

(54) CONNECTOR HAVING INTEGRATED HOUSING AND SHIELD SHELL

(71) Applicant: Yazaki Corporation, Tokyo (JP)

(72) Inventors: Yuhei Takeshita, Shizuoka (JP); Yasuhiro Tanaka, Shizuoka (JP); Noboru Hayasaka, Shizuoka (JP); Hiroaki Ono, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/590,870

(22) Filed: May 9, 2017

(65) Prior Publication Data

US 2017/0338587 A1 Nov. 23, 2017

(30) Foreign Application Priority Data

May 20, 2016 (JP) ..... 2016-101853

(51) Int. Cl.

| | |
|---|---|
| ***H01R 13/6581*** | (2011.01) |
| ***H01R 13/52*** | (2006.01) |
| ***H01R 24/20*** | (2011.01) |
| ***H01R 43/18*** | (2006.01) |
| *H01R 103/00* | (2006.01) |

(52) U.S. Cl.

CPC ..... *H01R 13/5219* (2013.01); *H01R 13/6581* (2013.01); *H01R 24/20* (2013.01); *H01R 43/18* (2013.01); *H01R 2103/00* (2013.01)

(58) Field of Classification Search

CPC . H01R 13/5219; H01R 13/6581; H01R 24/20
USPC ..... 439/271
See application file for complete search history.

(56) References Cited

U.S. PATENT DOCUMENTS

| | | | | |
|---|---|---|---|---|
| 5,484,301 | A * | 1/1996 | Koumatsu | H01R 13/5221 439/271 |
| 8,257,107 | B2 * | 9/2012 | Tsuruta | H01R 13/6581 439/362 |
| 8,662,920 | B2 * | 3/2014 | Ishibashi | H01R 13/6592 439/564 |
| 8,992,242 | B2 * | 3/2015 | Casses | H01R 13/5219 439/271 |
| 9,048,584 | B2 * | 6/2015 | Thackston | H01R 13/6581 |

FOREIGN PATENT DOCUMENTS

| | | | | |
|---|---|---|---|---|
| JP | 2014-103021 | A | 6/2014 | |
| WO | WO 2012056274 | A1 * | 5/2012 | H01R 13/5219 |

* cited by examiner

*Primary Examiner* — Renee Luebke
*Assistant Examiner* — Paul Baillargeon
(74) *Attorney, Agent, or Firm* — Kenealy Vaidya LLP

(57) ABSTRACT

A connector includes a female terminal; a female housing; a shield shell which is formed in a tubular conductive material in which both ends are opened, the shield shell being integrated with the female housing in a state in which at least one of an outer circumferential side and an inner circumferential side of an end portion on an insertion direction side to the male connector is exposed as an annular exposed surface, and the female terminal and/or the electric wire being disposed inside the shield shell; and a sealing member which has a tubular sealing portion interposed between the male housing of the fitted male connector or the shield shell and the exposed surface as a seal side exposed surface opposed to the male housing or the shield shell, and suppresses entry of liquid therebetween by the sealing member.

6 Claims, 15 Drawing Sheets

CONNECTOR HAVING INTEGRATED HOUSING AND SHIELD SHELL

CROSS-REFERENCE TO RELATED APPLICATION(S)

The present application claims priority to and incorporates by reference the entire contents of Japanese Patent Application No. 2016-101853 filed in Japan on May 20, 2016.

BACKGROUND OF THE INVENTION

1. Field of the Invention

The present invention relates to a connector.

2. Description of the Related Art

Conventionally, in a female connector and a male connector to be fitted to each other, there has been a technique of suppressing entry of noise to a terminal or an electric wire, by providing a metallic tubular shield shell in each synthetic resin housing. Between the female connector and the male connector, the shield shells of them come into contact with each other and are electrically connected when both the connectors are fitted. Further, in order to secure liquid-tightness (sealing property) from the outside in a fitted state between the female connector and the male connector, a tubular sealing member is provided between the mutually tubular fitting portions. This kind of connector is disclosed, for example, in the Japanese Patent Application Laid-open No. 2014-103021.

Incidentally, in the conventional female connector and the male connector, the outer circumferential surface or the inner circumferential surface of the tubular portion of the housing covering at least a part of the wall surface of the shield shell is used as the respective sealing surfaces, thereby obtaining the necessary sealing surface shape required for securing the sealing property. That is, in the female connector and the male connector, the sealing member is disposed between the sealing surfaces of the respective housings. Therefore, at the fitting location between the female connector and the male connector, in a direction orthogonal to the fitting direction, the shield shell of one connector, the housing of the one connector, the sealing portion of the sealing member, and a housing of the other connector are at least stacked. Therefore, the conventional connector has room for downsizing the body at the fitting location.

SUMMARY OF THE INVENTION

Accordingly, an object of the present invention to provide a connector capable of reducing the size of the body of a fitting location.

In order to achieve the above mentioned object, a connector according to one aspect of the present invention includes a terminal to which each of an electric wire and a counterpart terminal of a counterpart connector is electrically connected; a housing which is made of a synthetic resin material and holds the terminal on an inner side thereof; a shield shell which is molded into a tubular conductive material in which a tubular axis direction is made to match a connector insertion and extraction direction and both ends are opened, the shield shell being integrated with the housing in a state in which at least one of an outer circumferential side and an inner circumferential side of an end portion on an insertion direction side to the counterpart connector is exposed as an annular exposed surface, and the terminal and/or the electric wire being disposed inside the shield shell; and a sealing member which has a tubular sealing portion interposed between a counterpart housing or a counterpart shield shell of the fitted counterpart connector and the exposed surface as a seal side exposed surface opposite to the counterpart housing or the counterpart shield shell, and suppresses entry of liquid therebetween by the sealing member.

According to another aspect of the present invention, in the connector, it is preferable that the shield shell has an annular connecting wall surface connected to the seal side exposed surface on a extraction direction side from the counterpart connector, and has an annular sealing surface into which the sealing portion is brought into close contact, and an annular facing surface on the extraction direction side to the sealing surface, on the seal side exposed surface, the sealing member has a tubular connecting portion which is connected to the sealing portion on the extraction direction side and faces at least a part of the facing surface in a circumferential direction, and the housing has a tubular portion that is brought into contact with the connecting wall surface in the circumferential direction.

According to still another aspect of the present invention, in the connector, it is preferable that the housing has a holding portion which holds the sealing member and performs positioning on the seal exposed surface of the sealing member, on a side of the tubular portion orthogonal to the tubular axis direction, and on a wall surface opposite to a wall surface facing the connecting wall surface of the shield shell, a the sealing member has a holding target portion which is connected to the connecting portion on the extraction direction side and is held by the holding portion.

According to still another aspect of the present invention, in the connector, it is preferable that when the shield shell has the seal side exposed surface on the outer circumferential surface side, the housing is a molded body which is insert-molded with an insert molding metal die having an annular contact surface which comes into contact with at least a part of the facing surface of the shield shell in the circumferential direction, and interposing a cavity between at least a joining portion between the metal dies and the sealing surface, and, the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

According to still another aspect of the present invention, in the connector, it is preferable that, when the shield shell has the seal side exposed surface on the outer circumferential surface side, the housing is a molded body which is insert-molded with an insert molding metal die which has an annular contact surface which comes into contact with at least a part of the facing surface of the shield shell in the circumferential direction and an annular non-contact surface which is spaced apart from the sealing surface in the circumferential direction, and in which an annular cavity is interposed between the annular non-contact surface and the sealing surface, and the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a connector according to the present invention will be described in detail with reference to the drawings. The present invention is not limited by this embodiment.

Embodiment

The connector of this embodiment includes at least a terminal, a housing, a shield shell, and a sealing member. The connector is fitted into a counterpart connector by inserting into the counterpart connector to physically and electrically connect its own terminal and the counterpart terminal, and secures the liquid-tightness (sealing property) between the connector and the counterpart connector. Meanwhile, the connector is extracted from the counterpart connector, and the physical and electrical connection between the terminals is eliminated. In this connector, an insertion direction (a fitting direction) and an extraction direction with respect to the counterpart connector are opposite to each other. Hereinafter, the insertion direction is referred to as a "connector insertion direction", the fitting direction is referred to as a "connector fitting direction", and the extraction direction is referred to as a "connector extraction direction". Further, when these bidirectional orientations are not specified, they are referred to as a "connector insertion and extraction direction". As described above, each of these directions indicates the orientation of the connector of this embodiment with respect to the counterpart connector. However, in the following description of the counterpart connector (a male connector 2), for the sake of convenience of description, the direction indicates the orientation of this counterpart connector with respect to the connector (a female connector 1) of this embodiment.

As long as the connector has the structure described in detail below, the connector may be a female connector having a female terminal or may be a male connector having a male terminal. In the following description, this connector will be described as a female connector, and the counterpart connector will be described as a male connector. One of the embodiments of the connector will be described with reference to FIGS. 1 to 15.

Figure 1:
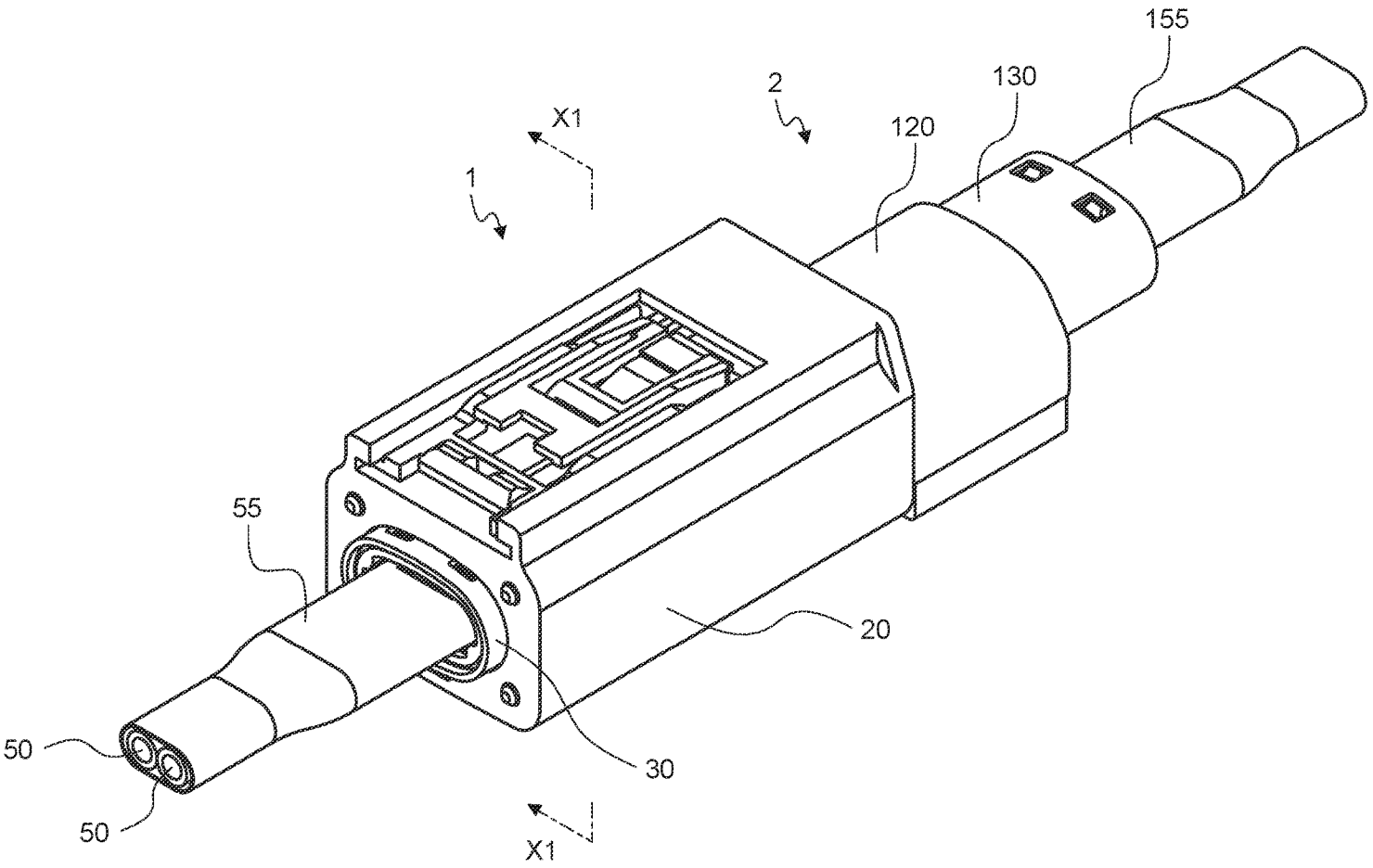
FIG. 1 is a perspective view illustrating a fitting state of a female connector and a male connector according to an embodiment.
Figure 2:
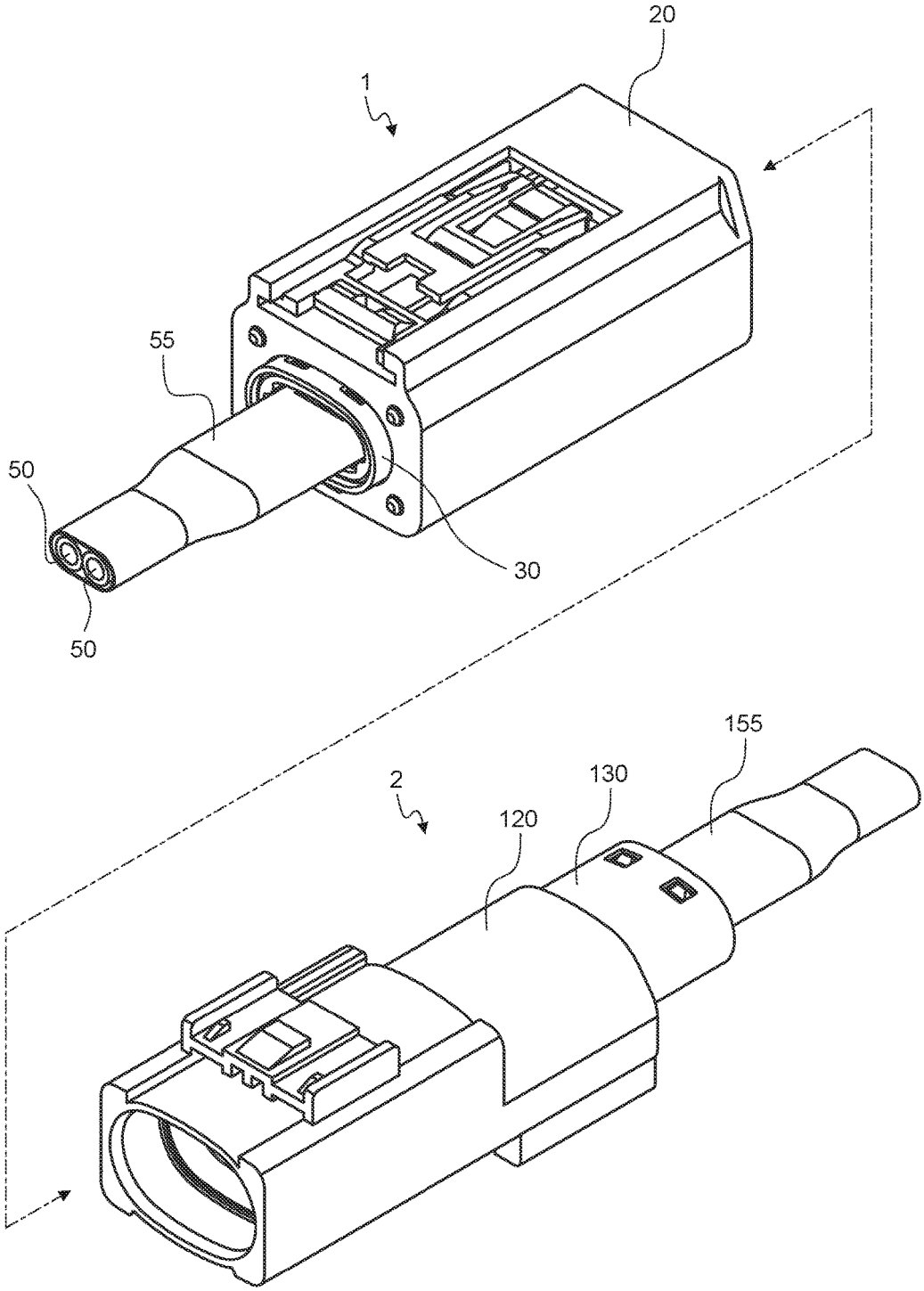
FIG. 2 is a perspective view illustrating a state before fitting of the female connector and the male connector according to the embodiment.
Figure 3:
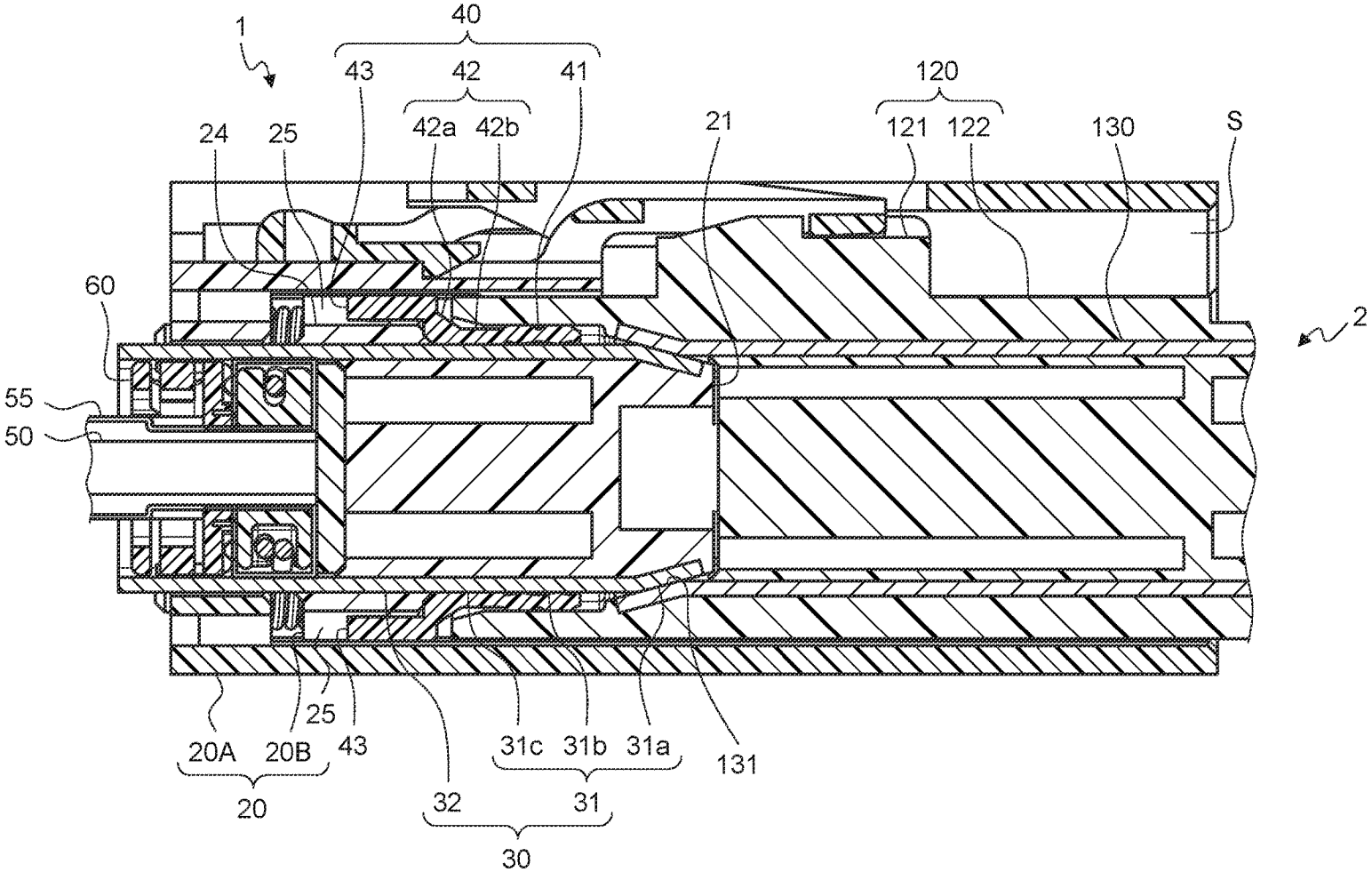
FIG. 3 is a cross-sectional view taken along a line X1-X1 of FIG. 1.

Reference numerals 1 and 2 in FIGS. 1 to 3 indicate the female connector and the male connector of this embodiment, respectively.

Figure 12:
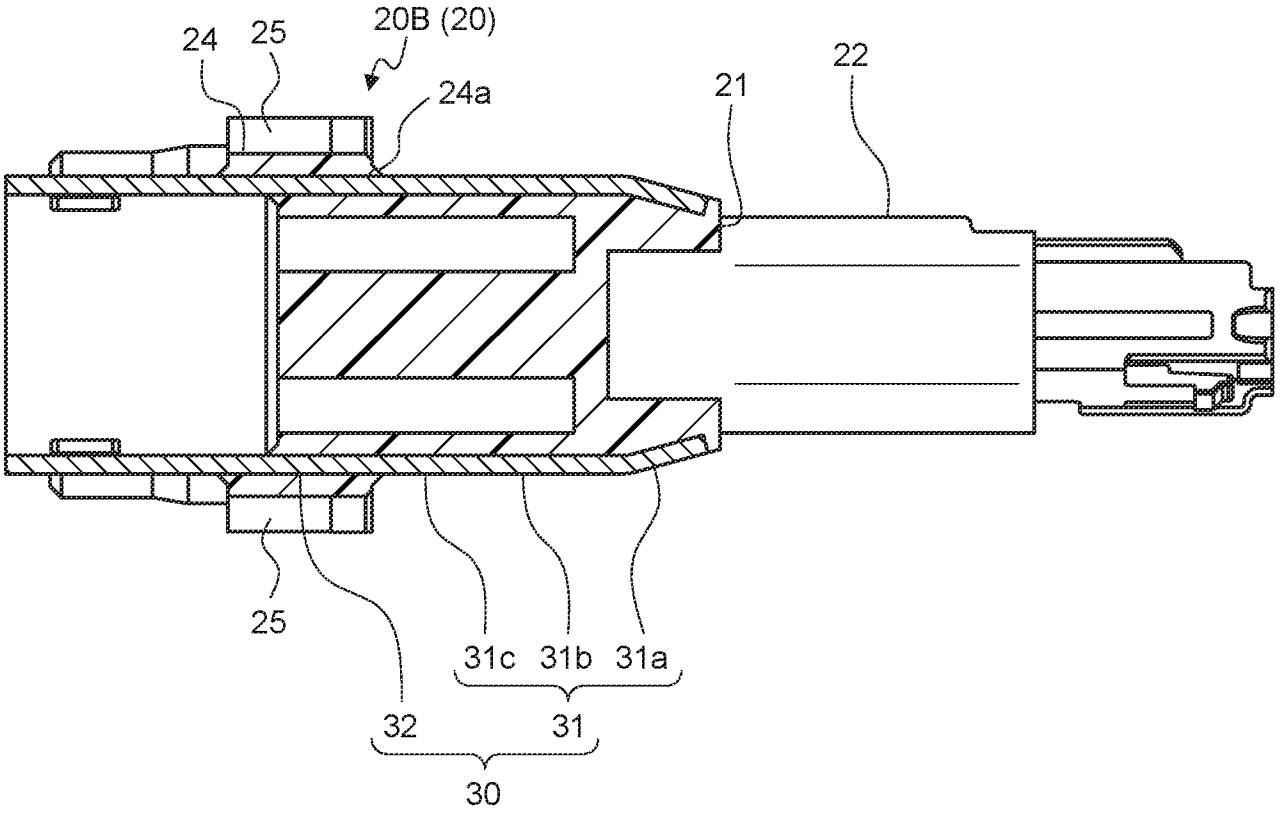
FIG. 12 is a cross-sectional view illustrating an inner housing and a shield shell of a female connector after insert molding.
Figure 13:
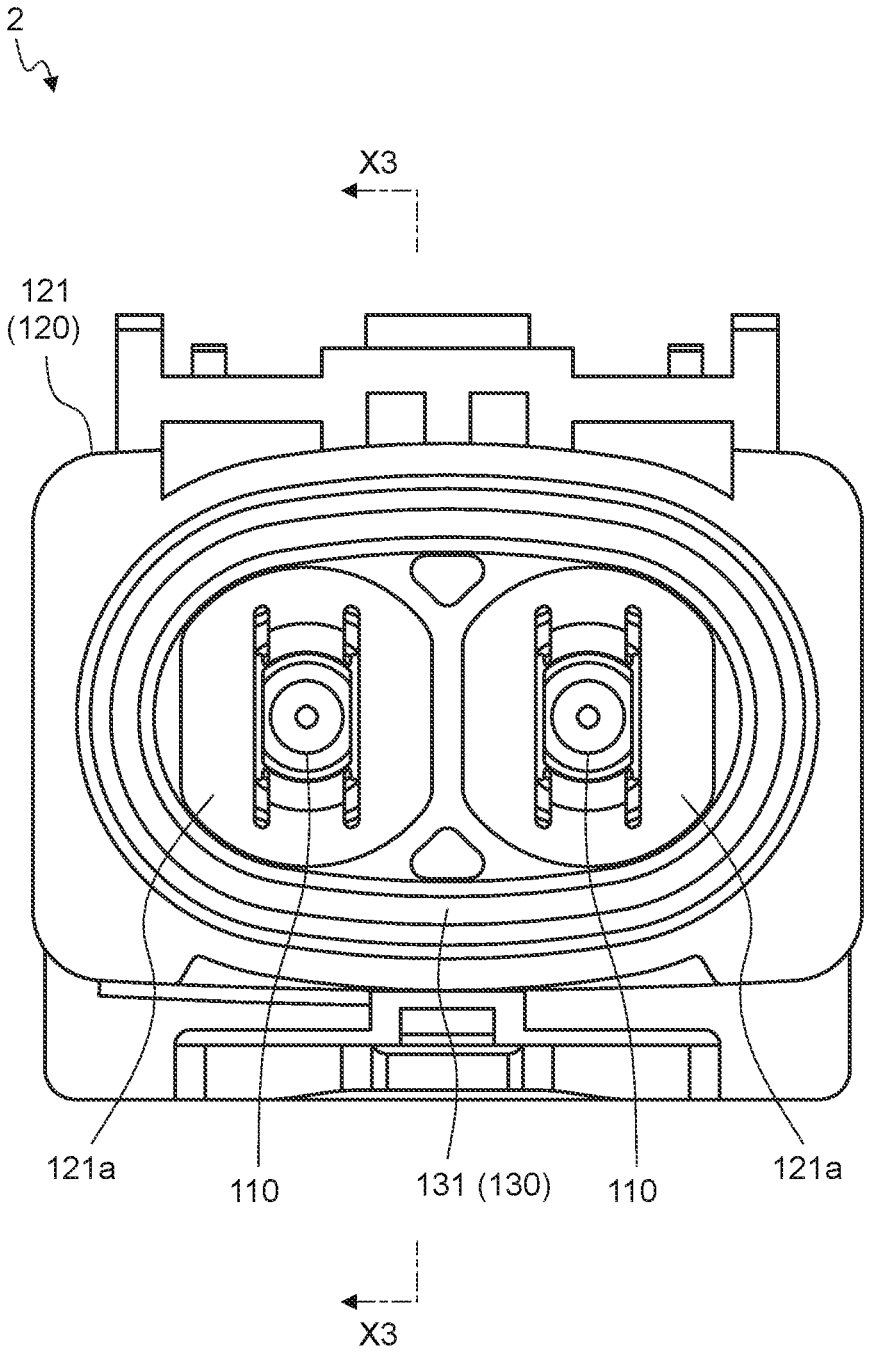
FIG. 13 is a front view of the male connector as seen from the opening side.
Figure 14:
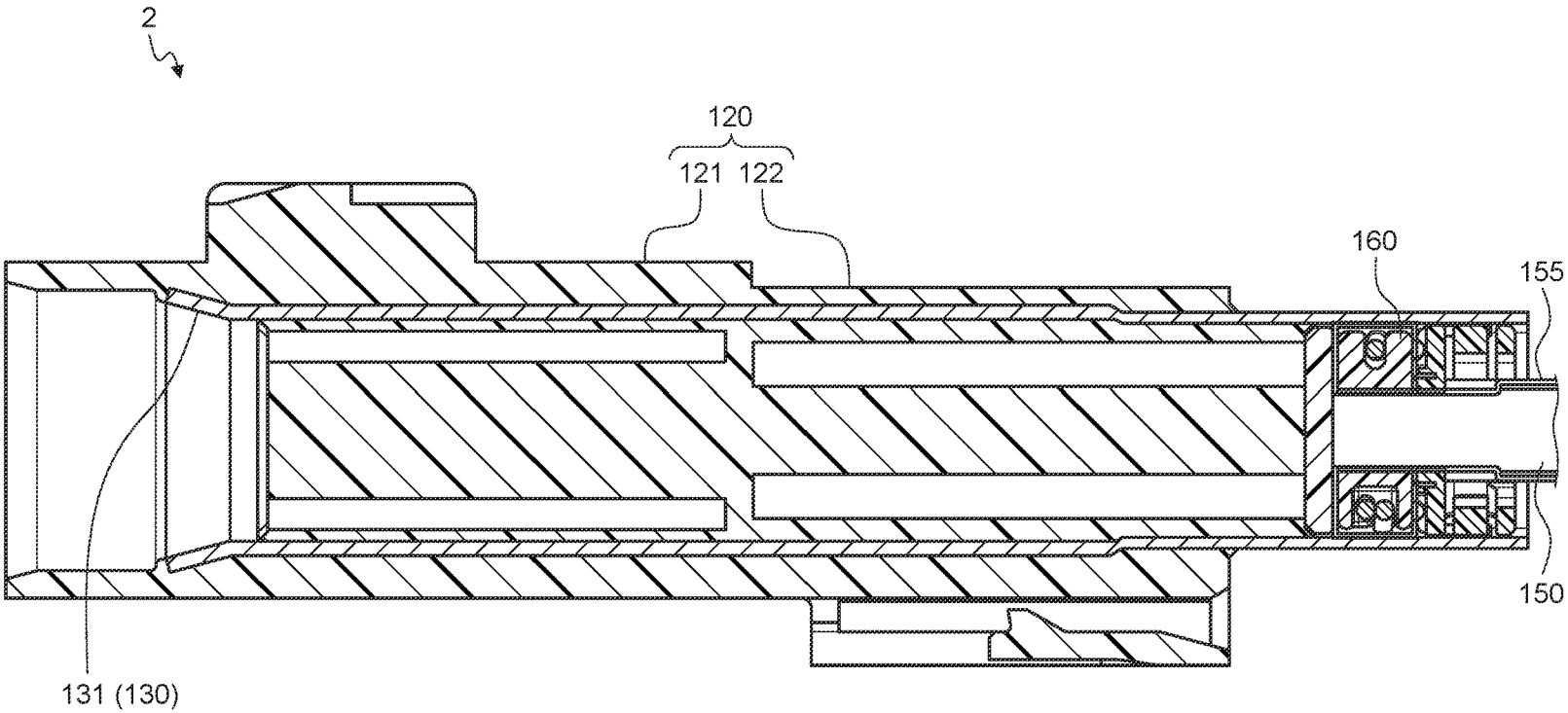
FIG. 14 is a cross-sectional view taken along a line X3-X3 of FIG. 13.
Figure 15:
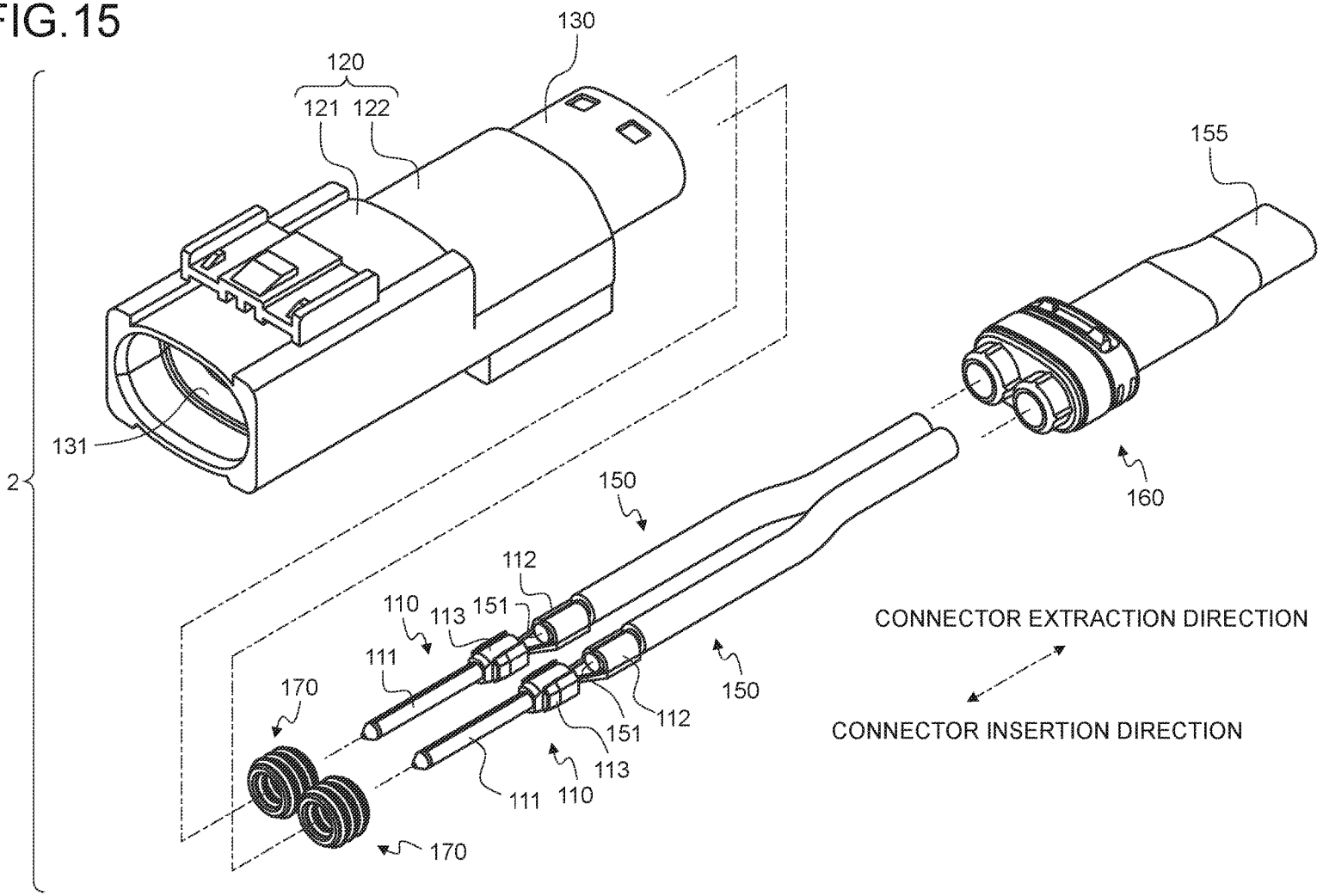
FIG. 15 is an exploded perspective view of a male connector.

A female connector 1 includes a terminal 10 (hereinafter referred to as a "female terminal") molded into a female shape by a conductive material such as metal, and a housing (hereinafter referred to as a "female housing") 20 which holds the female terminal 10 inside (see FIGS. 4 to 8). Furthermore, the female connector 1 is provided with a shield shell 30 integrated with the female housing 20 (FIGS. 4 to 12). Furthermore, the female connector 1 is provided with a sealing member 40 (FIGS. 4 to 8) which suppresses entry of liquid between the female connector 1 and the male connector 2. In the female connector 1, two female terminals 10 are arranged side by side in the same direction. Meanwhile, the male connector 2 includes a terminal 110 (hereinafter referred to as a "male terminal") molded into a male shape by a conductive material such as metal, a housing (hereinafter referred to as a "male housing") 120 which holds the male terminal 110 inside, and a shield shell 130 integrated with the male housing 120 (FIGS. 13 to 15). In the male connector 2, two male terminals 110 are arranged side by side in the same direction.

Figure 7:
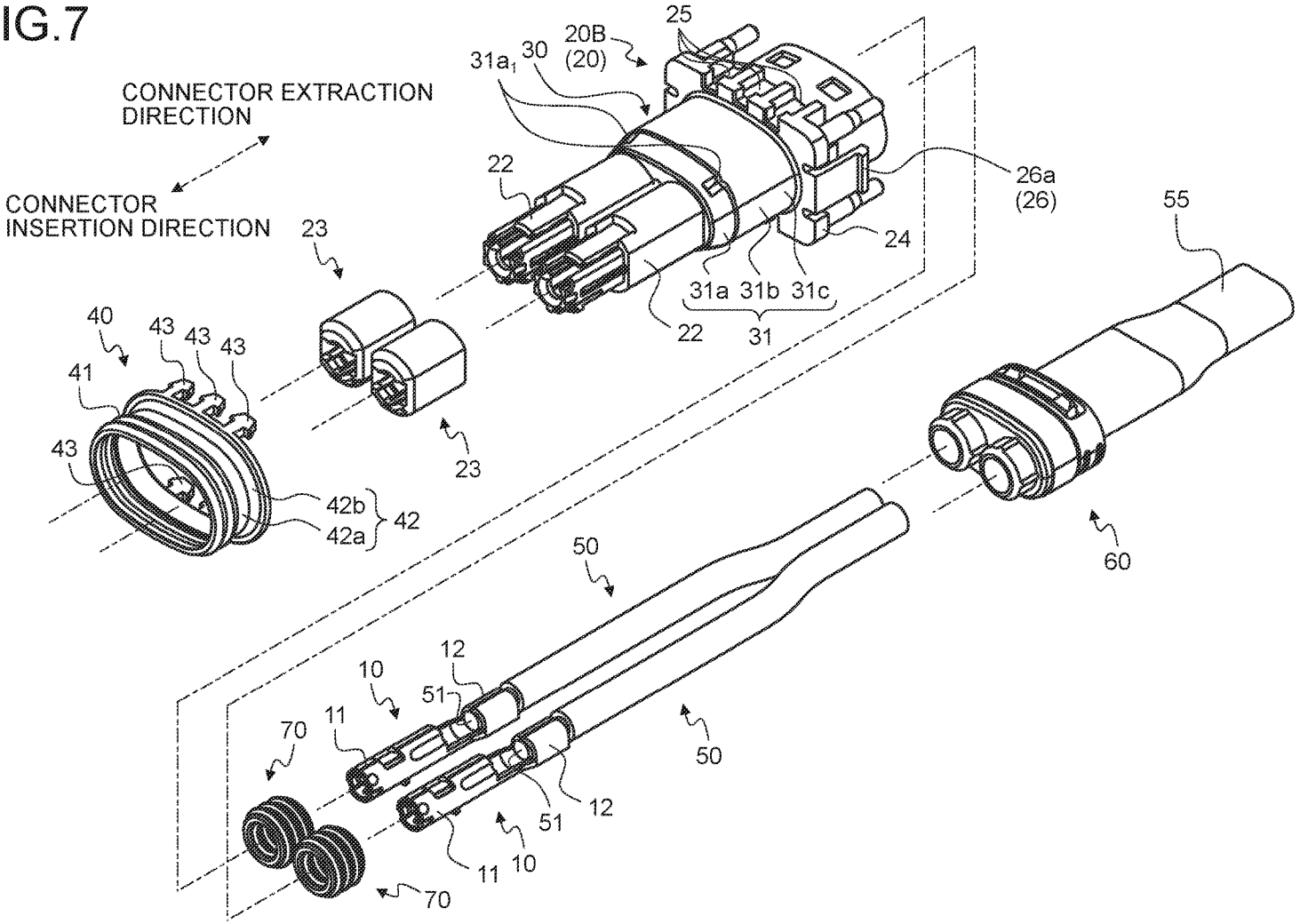
FIG. 7 is an exploded perspective view of internal components of the female connector.

The female terminal 10 has a terminal connecting portion 11 which is physically and electrically connected to the male terminal 110, and an electric wire connecting portion 12 which is physically and electrically connected to an electric wire 50 (FIG. 7). As with the female terminal 10, the male terminal 110 has a terminal connecting portion 111 which is physically and electrically connected to the female terminal 10, and an electric wire connecting portion 112 which is physically and electrically connected to an electric wire 150 (FIG. 15). In this example, the terminal connecting portion 111 of the male terminal 110 is formed into a cylindrical shape in which an axial direction is made to match the connector insertion and extraction direction, and the terminal connecting portion 11 of the female terminal 10 is formed into a cylindrical shape in accordance with this shape. In addition, the respective electric wire connecting portions 12 and 112 are formed so that the respective electric wires 50 and 150 can be drawn out in the connector extraction direction. Core wires 51 and 151 of the terminals of the electric wires 50 and 150 are fixed to the electric wire connecting portions 12 and 112 by crimping such as caulking.

The female housing 20 and the male housing 120 are molded into a predetermined shape by an insulating material such as a synthetic resin material. The female housing 20 and the male housing 120 of this example, as will be described in detail later, have a tubular hood with both ends open, and a terminal holding element which holds the terminals inside the hood. The hood uses the internal space as a storage chamber of the terminal, and is disposed in a state of integrating the terminal holding element in the internal space. In the hood, a tubular axis direction connecting the openings at both ends is a connector insertion and extraction direction, and the terminal connecting portion 11 (111) is disposed at the end portion on the connector insertion direction side (the end portion on the counterpart connector side) inside the hood, and the electric wire connecting portion 12 (112) is disposed at the end portion on the connector extraction direction side inside the hood. The terminal holding element inside the hood is formed so that such a terminal arrangement is permitted.

Figure 5:
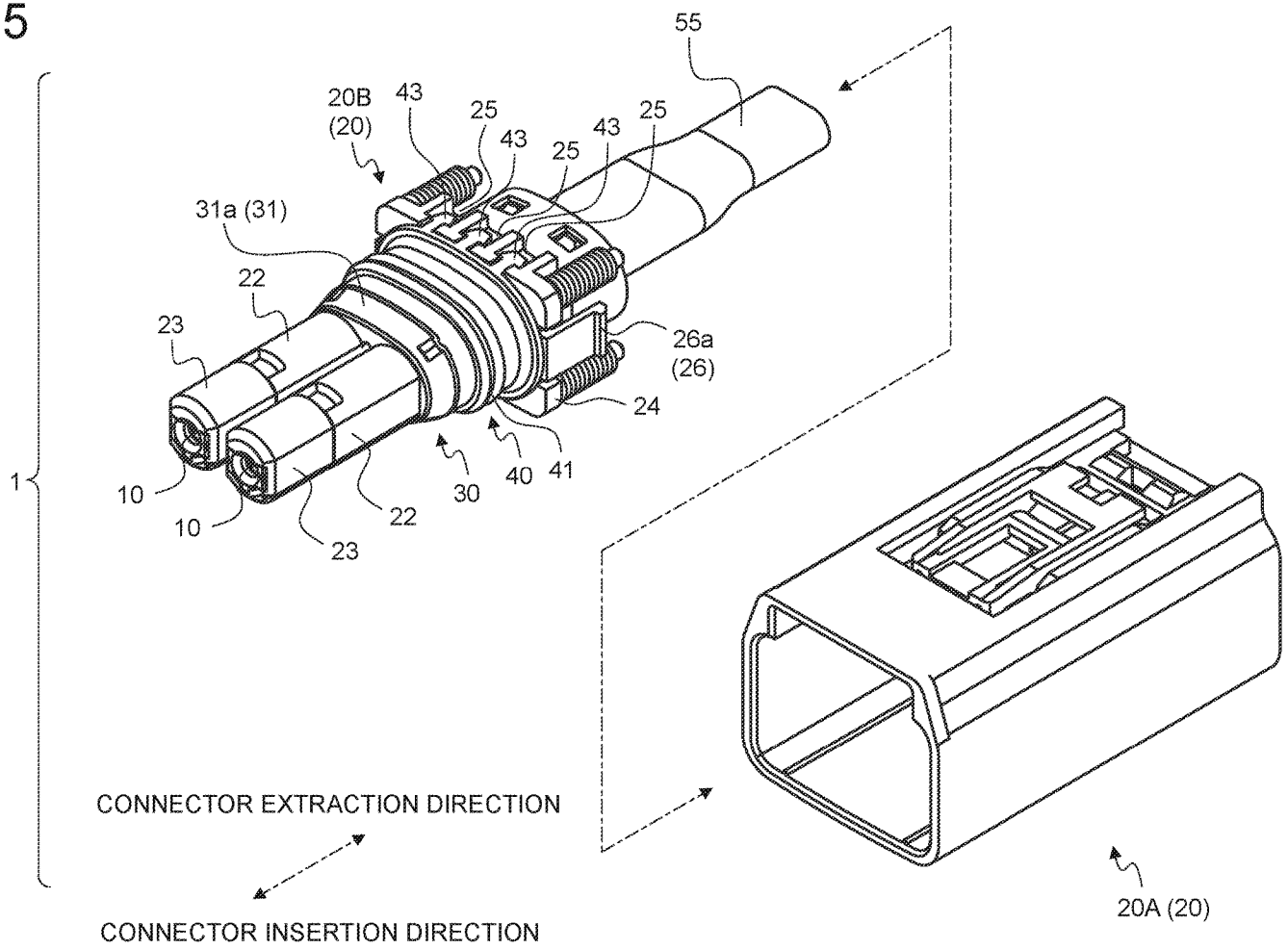
FIG. 5 is an exploded perspective view of the female connector.

Specifically, the female housing 20 has a two-piece structure of an outer housing 20A and an inner housing 20B (FIG. 5).

The outer housing 20A forms the above-described hood, and is molded into a tubular shape with both ends opened. In this example, the outer housing 20A is molded into a rectangular tubular shape.

Figure 6:
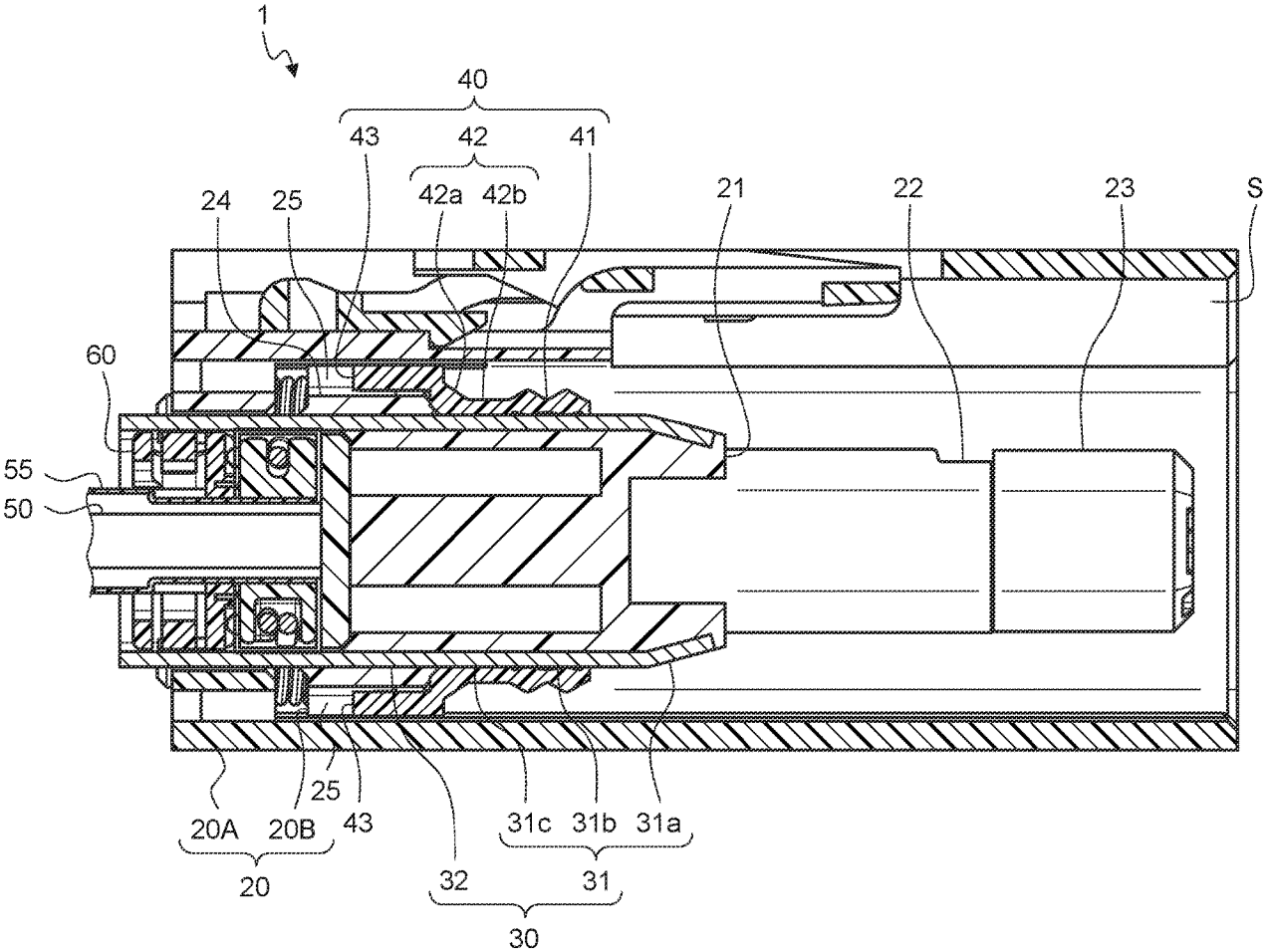
FIG. 6 is a cross-sectional view taken along a line X2-X2 of FIG. 4.
Figure 8:
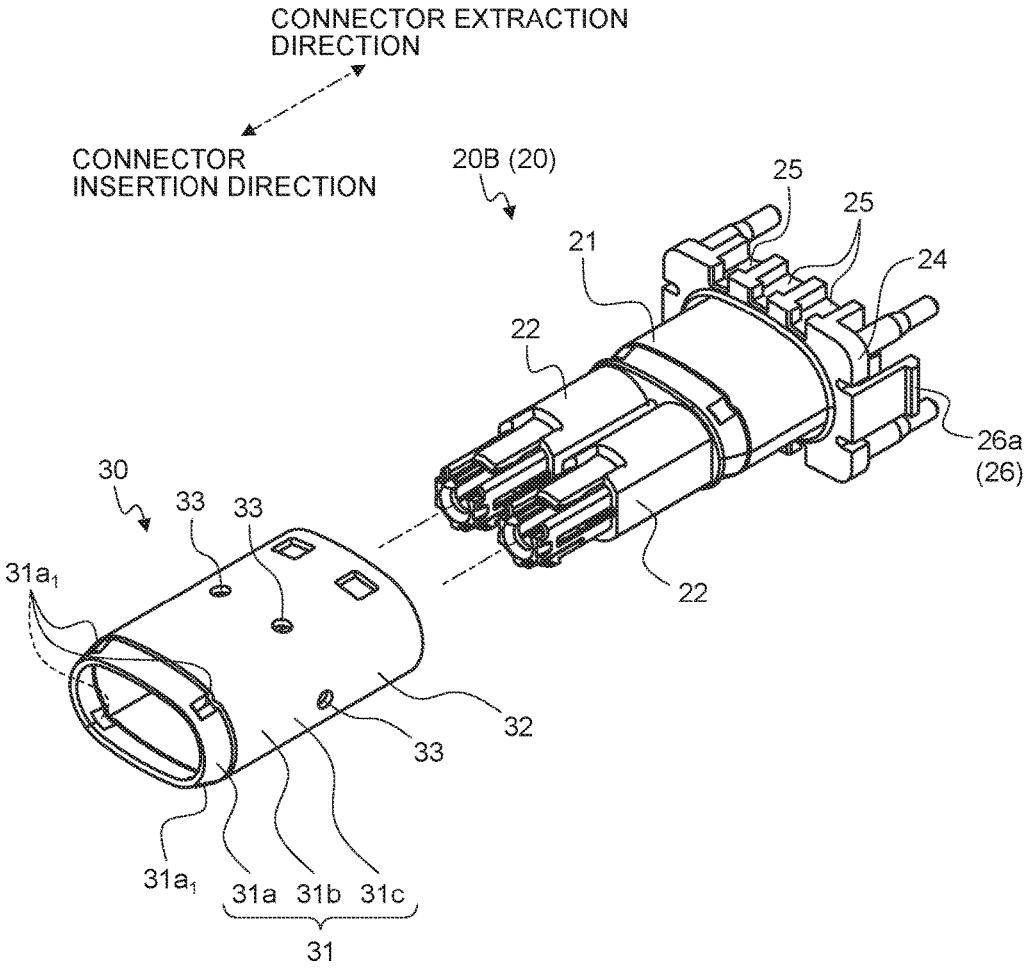
FIG. 8 is an exploded perspective view of an inner housing and a shield shell of the female connector.

The inner housing 20B has a terminal storage portion 21 in which the respective female terminals 10 are stored (FIGS. 6 and 8). The terminal storage portion 21 is molded into a tubular shape in which the tubular axis direction is made to match the connector insertion and extraction direction and both ends are opened, and storage chambers (not illustrated) for each female terminal 10 are formed inside the terminal storage portion 21. The terminal storage portion 21 of this example is molded into a rectangular tubular shape. Further, in the storage chamber of this example, the electric wire connecting portion 12 of the female terminal 10 and the terminal of the electric wire 50 connected to the electric wire connecting portion 12 are stored.

The female terminal 10 and the electric wire 50 are inserted from the opening side of the end portion of the terminal storage portion 21 on the connector extraction direction side (specifically, the opening at the end portion of the shield shell 30 on the connector extraction direction side). Therefore, the electric wire 50 is pulled out to the outside from the opening of the shield shell 30. The opening is closed with a shield connecting element 60 molded by an insulating material such as a synthetic resin material (FIG. 7). The shield connecting element 60 is made of at least one molded body to be fitted into the opening, and has through-holes through which the respective electric wires 50 are inserted. Further, the shield connecting element 60 holds a braid 55 made of a conductive material, and physically and electrically connects the braid 55 to the shield shell 30. The braid 55 covers the respective electric wires 50 to suppress entry of noise, and is knitted in a tubular and mesh form. The sealing member 70 is disposed on the shield connecting element 60 so as to suppress the entry of liquid from the side of the shield connecting element 60 toward the inside of the terminal storage portion 21. The sealing member 70 is provided for each electric wire 50.

Furthermore, in the inner housing 20B, two terminal holding portions 22 as the above-described terminal holding elements are disposed side by side at the opening at the end portion of the terminal storage portion 21 on the connector insertion direction side, for each female terminal 10 (FIGS. 7 and 8). The terminal holding portions 22 are formed into a tubular shape in which the tubular axis direction is made to match the connector insertion and extraction direction and both ends are opened, and the terminal holding portions 22 extend from the opening of the terminal storage portion 21 along the tubular axis direction. The inside of the terminal holding portion 22 communicates with the storage chamber of the terminal storage portion 21 via the opening at the end portion on the connector extraction direction side. Therefore, in the terminal holding portion 22 of this example, the terminal connecting portion 11 is stored and held inside the terminal holding portion 22. A tubular lid member 23 having both open ends is attached to an end portion of the terminal holding portion 22 on the connector insertion direction side (FIG. 7). The male terminal 110 is inserted via the openings of the lid member 23 and the terminal holding portion 22, and is inserted into the terminal connecting portion 11 of the female terminal 10 with progress of the insertion. The opening of the end portion of the terminal storage portion 21 on the connector insertion direction side is closed, except for a portion communicating with the terminal holding portion 22.

Further, a tubular portion 24 in which the tubular axis direction is made to match the connector insertion and extraction direction and both ends are opened is provided in the inner housing 20B (FIGS. 5, 7 and 8). The tubular portion 24 is provided with a holding portion 25 of the sealing member 40. The tubular portion 24 and the holding portion 25 will be described later in detail.

Figure 4:
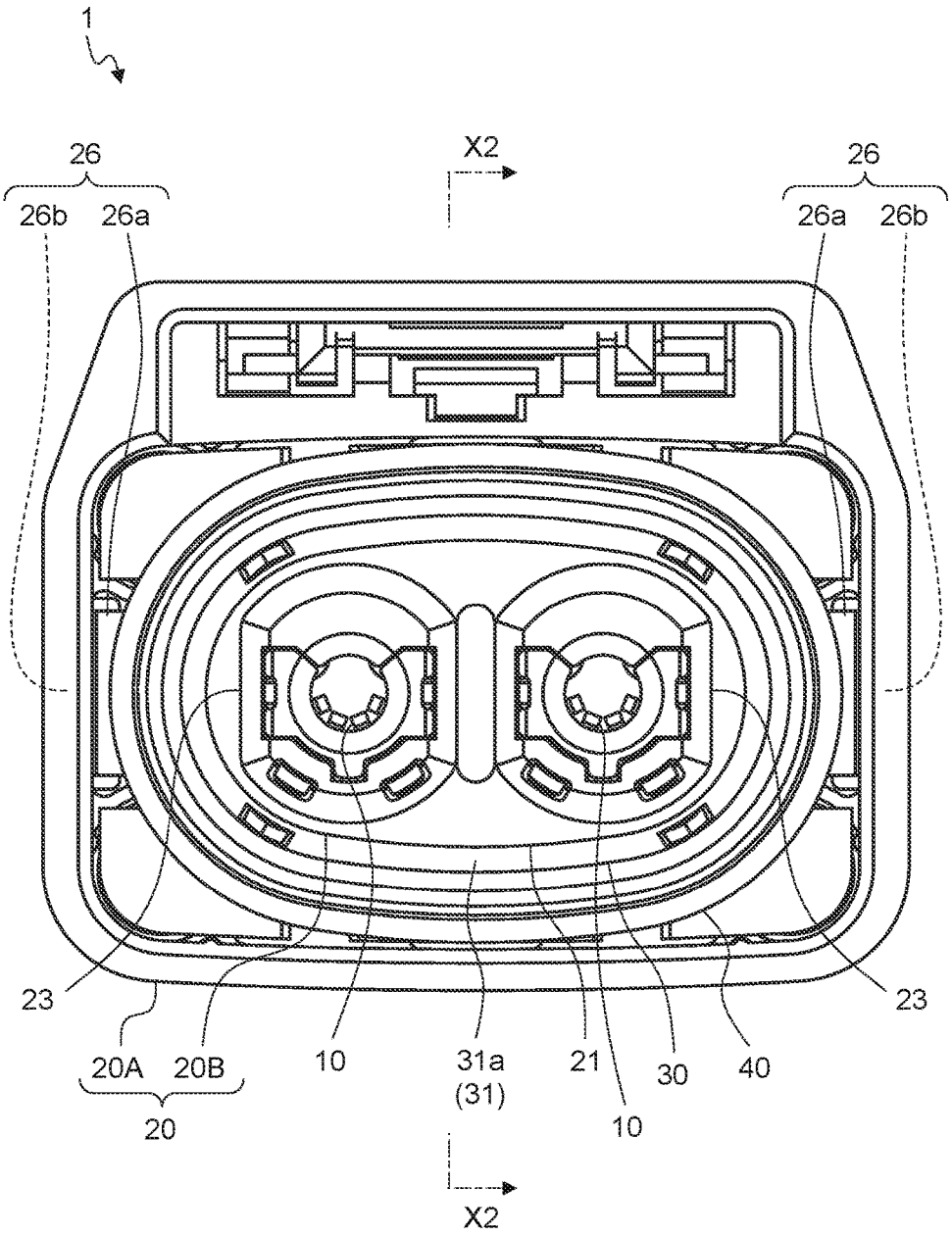
FIG. 4 is a front view of the female connector as seen from an opening side.

In the female housing 20, each of the outer housing 20A and the inner housing 20B has an engaging portion, and the outer housing 20A and the inner housing 20B are fixed to each other by an engaging mechanism 26 made up of respective engaging portions (FIG. 4). The inner housing 20B of this example is inserted inward with respect to the outer housing 20A along the tubular axis direction from the opening of the end portion on the connector insertion direction side. The engaging mechanism 26 engages the respective engaging portions with each other in accordance with the insertion operation, thereby integrating the outer housing 20A and the inner housing 20B. For example, in the engaging mechanism 26, one engaging portion is formed into a claw shape, and the other engaging portion is formed into a shape in which a claw portion is caught. In the engaging mechanism 26 illustrated in FIGS. 4 and 5, a claw-shaped engaging portion 26*a* is provided on the outer wall surface of the terminal storage portion 21 of the inner housing 20B, and an engaging portion 26*b* with which the claw portion is caught is provided on the outer housing 20A. In FIG. 5, the engaging portion 26*b* of the outer housing 20A is not illustrated. In this example, the engaging mechanisms 26 are provided in two places.

In the female housing 20, the shield shell 30 is integrated with the inner housing 20B (FIGS. 7 and 8).

The shield shell 30 is provided for countermeasures against noise, and is formed of a conductive material such as metal in a tubular shape in which the tubular axis direction is made to match the connector insertion and extraction direction and both ends are opened (FIG. 8). Since the shield shell 30 is integrated with the terminal storage portion 21 or the like of the inner housing 20B, the shield shell 30 is molded into a rectangular tubular shape in accordance with the shape of the terminal storage portion 21. Further, the shield shell 30 is physically and electrically connected to the shield shell 130 of the male connector 2 after the male connector 2 is completely fitted.

The shield shell 30 is integrated with the inner housing 20B in a state in which at least one of the outer circumferential side and the inner circumferential side of the end portion on the connector insertion direction side is exposed as an annular exposed surface. At least a surface (hereinafter referred to as a "seal side exposed surface") used as a sealing surface between the exposed surface and the sealing member 40 is provided as the exposed surface. For example, when a rectangular tubular male housing 120 or a rectangular tubular shield shell 130 to be described later of the fitted male connector 2 covers the shield shell 30 from the outside, in the direction orthogonal to the tubular axis direction, the seal side exposed surface is disposed at a position which faces the inner circumferential surface of the male housing 120 or the shield shell 130. Therefore, the shield shell 30 in this case is integrated with the inner housing 20B in a state in which the outer circumferential side of the end portion on the connector insertion direction side is exposed as an annular seal side exposed surface. Meanwhile, when the male housing 120 or the shield shell 130 of the fitted male connector 2 is inserted to the inside of the shield shell 30 in the direction orthogonal to the tubular axis direction, the seal side exposed surface is disposed at a position facing the outer circumferential surface of the male housing 120 or the shield shell 130. Therefore, the shield shell 30 in this case is integrated with the inner housing 20B in a state in which the inner circumferential side of the end portion on the connector insertion direction side is exposed as an annular seal side exposed surface. In this example, since the former fitting form between the male and female housings is adopted, the seal side exposed surface 31 is provided on the outer circumferential side of the shield shell 30 (FIGS. 5, 7, and 8). For this reason, the shield shell 30 of this example is disposed to cover the outer circumferential surface of the terminal storage portion 21 on the inner circumferential surface thereof, and is integrated in a state in which the inner circumferential surface of the shield shell 30 itself is brought into contact with the outer circumferential surface of the terminal storage portion 21.

In the female connector 1, the integration of the inner housing 20B and the shield shell 30 may be performed by fitting them each other, or may be performed by insert molding of the inner housing 20B with respect to the shield shell 30.

The female terminal 10 and/or the electric wire 50 is disposed in a state of being inserted through the inside of the shield shell 30, and the shield shell 30 suppresses the entry of noise into the female terminal 10 and/or the electric wire 50. According to a positional relation of the shield shell 30 of this example to the terminal storage portion 21, the electric wire connecting portion 12 of the female terminal 10, and the terminal of the electric wire 50 connected to the electric wire connecting portion 12 are stored inside the shield shell 30.

The shield shell 30 has an annular connecting wall surface 32 which is connected to the seal side exposed surface 31 on the connector extraction direction side (FIGS. 6 and 8). The tubular portion 24 of the inner housing 20B illustrated above is brought into contact with the connecting wall surface 32 in the circumferential direction. Therefore, the tubular portion 24 is molded into a rectangular tubular shape. When the seal side exposed surface 31 is provided on the outer circumferential surface of the shield shell 30, the tubular portion 24 is disposed to cover the connecting wall surface 32 on the outer circumferential surface of the shield shell 30 with the inner circumferential surface. Meanwhile, when the seal side exposed surface 31 is provided on the inner circumferential surface of the shield shell 30, the tubular portion 24 is disposed so that the outer circumferential surface is covered with the connecting wall surface 32 on the inner circumferential surface of the shield shell 30. In this example, the seal side exposed surface 31 is provided on the outer circumferential surface of the shield shell 30, and the connecting wall surface 32 is provided on the same outer circumferential surface. Accordingly, the tubular portion 24 is disposed outside the shield shell 30. That is, the shield shell 30 of this example is interposed between the terminal storage portion 21 on the inner side and the tubular portion 24 on the outer side in a direction orthogonal to the tubular axis direction.

The seal side exposed surface 31 is roughly divided into first to third annular surfaces 31*a* to 31*c* in the connector insertion and extraction direction (FIGS. 6, 7 and 8). A first annular surface 31*a* is disposed at the end portion of the seal side exposed surface 31 on the connector insertion direction side, and is used as a contact portion with the shield shell 130 of the male connector 2. Therefore, hereinafter, the first annular surface 31*a* will be referred to as an electrical connection surface 31*a*. The electrical connection surface 31*a* may have an annular wall surface as a contact, or may have a bulged portion bulged from the annular wall surface as a contact. In the electrical connection surface 31*a* of this example, bulged portions $\mathbf{31}a_1$ are provided at four locations (FIGS. 4, 7 and 8), and are used as contacts. A second annular surface 31*b* is used as an annular sealing surface for bringing tubular sealing portions 41 to be described later of the sealing member 40 into close contact with each other. Hereinafter, the second annular surface 31*b* will be referred to as a sealing surface 31*b*. The sealing surface 31*b* is disposed on the connector extraction direction side with respect to the electrical connection surface 31*a*. A third annular surface 31*c* is used as an annular facing surface between a second annular contact surface 202 and an annular non-contact surface 204 of an insert molding metal die to be described later. Hereinafter, the third annular surface 31*c* will be referred to as a facing surface 31*c*. The facing surface 31*c* is disposed on the connector extraction direction side with respect to the sealing surface 31*b*.

The sealing member 40 suppresses the entry of liquid between the female connector 1 and the male connector 2 fitted to each other. The sealing member 40 is disposed on the seal side exposed surface 31 of the shield shell 30 of the female connector 1, and is used to suppress the entry of liquid into the contact portion between the shield shell 30 and the shield shell 130 of the male connector 2. Therefore, the sealing member 40 has a tubular sealing portion 41 interposed between the male housing 120 or the shield shell 130 of the fitted male connector 2 and the sealing surface 31*b* on the seal side exposed surface 31 (FIGS. 3, 6 and 7). The sealing member 40 suppresses the entry of liquid into the contact portion between the respective shield shells 30 and 130, by suppressing the entry of liquid between the sealing members 40 using the sealing portion 41. Therefore, in the sealing portion 41, lips are formed on the outer circumferential surface side and the inner circumferential surface side, respectively, and each lip is brought into close contact with the sealing surface 31*b* and a wall surface of the male housing 120 or the shield shell 130 facing the sealing surface 31*b*. The sealing portion 41 is molded into a rectangular tubular shape in accordance with the shape of the seal side exposed surface 31.

Further, the sealing member 40 has a tubular connecting portion 42 which is connected to the sealing portion 41 on the connector extraction direction side, and faces at least a part of the facing surface 31*c* of the seal side exposed surface 31 of the shield shell 30 in the circumferential direction (FIGS. 6 and 7). The connecting portion 42 is molded into a rectangular tubular shape as in the sealing portion 41. The connecting portion 42 may be brought into contact with the facing surface 31*c*, or may be disposed to be spaced apart from the facing surface 31*c*.

The sealing member 40 is held by the inner housing 20B and is positioned on the seal side exposed surface 31 together with the holding thereof. For this reason, the inner housing 20B is provided with the holding portion 25 as illustrated above (FIG. 7). The holding portion 25 is provided on the side of the tubular portion 24 in the direction orthogonal to the tubular axis direction, and on a wall surface on the side opposite to the side facing the connecting wall surface 32 of the shield shell 30. In this example, three holding portions 25 are provided at positions facing each other in a direction orthogonal to the connector insertion and extraction direction. Meanwhile, the sealing member 40 is provided with a holding target portion 43 which is connected to the connecting portion 42 on the side of the connector extraction direction and is held by the holding portion 25 of the inner housing 20B (FIGS. 5, 6, and 7). The holding target portion 43 of this example is disposed to correspond to the position of each holding portion 25, and the three holding target portions 43 are connected at the end portion of the connecting portion 42 on the connector extraction direction side, at the positions facing each other in the direction orthogonal to the connector insertion and extraction direction.

In this example, the holding target portion 43 is formed into a shape like a flat-headed arrowhead projecting from the connecting portion 42 toward the connector extraction direction side. For example, the connecting portion 42 of this example has a tubular main body portion 42*a* with one end connected to the sealing portion 41, and a flange portion 42*b* connected to the other end of the main body portion 42*a* (see FIGS. 6 and 7). The holding target portion 43 protrudes from the flange portion 42*b*. The holding portion 25 is formed as a space or a groove into which the holding target portion 43 is fitted. The holding portion 25 locks the movement of the holding target portion 43 toward the connector insertion direction side, and locks the movement of the holding target portion 43 in the circumferential direction. Therefore, the combination of the holding portion 25 and the holding target portion 43 can suppress the positional deviation of the sealing member 40 with respect to the inner housing 20B and the shield shell 30 in the connector insertion direction side and in the circumferential direction. As described above, the combination of the holding portion 25 and the holding target portion 43 can hold the sealing member 40 on the inner housing 20B and can perform positioning of the sealing member 40 on the seal side exposed surface 31. The positional deviation of the sealing member 40 in the connector extraction direction, for example, may be suppressed by the shapes of the holding portion 25 and the holding target portion 43, and may be suppressed by locking the flange portion 42*b* to the tubular portion 24.

When the seal side exposed surface 31 is provided on the outer circumferential surface of the shield shell 30, the sealing member 40 is disposed to cover the seal side exposed surface 31 with the inner circumferential surface side. In this case, the holding target portion 43 is provided on the outer circumferential surface side of the tubular portion 24. Meanwhile, when the seal side exposed surface 31 is provided on the inner circumferential surface of the shield shell 30, the sealing member 40 is disposed so that the outer circumferential surface side is covered with the seal side exposed surface 31. In this case, the holding target portion 43 is provided on the inner circumferential surface side of the tubular portion 24. In this example, since the seal side exposed surface 31 is provided on the outer circumferential surface of the shield shell 30, the sealing member 40 is disposed outside the former shield shell 30. For this reason, the sealing member 40 of the example brings the lip of the sealing portion 41 on the inner circumferential surface side into close contact with the sealing surface 31*b* of the seal side exposed surface 31, and brings the lip of the sealing portion 41 on the outer circumferential surface side into close contact with the inner circumferential surface of the male housing 120 or the shield shell 130. Here, the lip of the sealing portion 41 on the outer circumferential surface side is brought into close contact with the inner circumferential surface of the male housing 120. The sealing member 40 of this example is disposed to cover the facing surface 31*c* with the inner circumferential surface of the connecting portion 42. Further, the sealing member 40 of this example is held by the holding target portion 43 disposed on the outer circumferential surface side of the tubular portion 24.

In the female connector 1 of this example, a tubular space S, in which an end portion on the connector insertion direction side is opened, is formed between the outer housing 20A, the inner housing 20B and the shield shell 30 (FIG. 6). The male connector 2 is fitted into the female connector 1, while being inserted into the tubular space S from the opening. The space S of this example is formed into a rectangular tubular shape.

The male connector 2 of this example includes a male terminal 110, a male housing 120 and a shield shell 130, as previously indicated.

The male housing 120 has a terminal storage portion 121 and a terminal holding portion 122 (FIGS. 13 to 15).

The terminal storage portion 121 is molded into a tubular shape in which the tubular axis direction is made to match the connector insertion and extraction direction and both ends are opened, and storage chambers 121*a* for each of the male terminals 110 are formed inside the terminal storage portion 121 (FIG. 13). The terminal connecting portion 111 of the male terminal 110 is stored in the storage chamber 121*a*. An end portion of the terminal storage portion 121 on the connector insertion direction side also serves as a part (a hood portion) of the hood, and is inserted into the rectangular tubular space S of the female connector 1. For this reason, the terminal storage portion 121 of this example is molded into a rectangular tubular shape matching the shape of the space S. The lip of the sealing portion 41 of the sealing member 40 on the outer circumferential surface side is brought into close contact with the inner circumferential surface of the hood portion after the connector is fitted.

The terminal holding portion 122 is molded into a tubular shape in which the tubular axis direction is made to match the connector insertion and extraction direction and both ends are opened, and the terminal holding portion 122 is disposed in the opening at the end portion of the terminal storage portion 121 on the connector extraction direction side. A storage chamber (not illustrated) for each male terminal 110 is formed inside the terminal holding portion 122, and the electric wire connecting portion 112 of the male terminal 110 and the terminal of the electric wire 150 connected to the electric wire connecting portion 112 are stored in the storage chamber. A holding target portion 113

(FIG. 15) of the male terminal 110 is fitted in the storage chamber and is held with the fitting.

The shield shell 130 is provided for countermeasures against noise, and is formed of a conductive material such as metal in a tubular shape in which the tubular axis direction is made to match the connector insertion and extraction direction and both ends are opened (FIGS. 13 to 15). Since the shield shell 130 is integrated with the male housing 120, the shield shell 130 is molded into a rectangular tubular shape in accordance with the shape of the male housing 120.

The shield shell 130 is disposed inside the male housing 120, and an end portion of the shield shell 130 on the connector extraction direction side protrudes from the male housing 120. The male terminal 110 and/or the electric wire 150 are disposed inside the illustrated shield shell 130 in the inserted state to suppress noise from entering the male terminal 110 and/or the electric wire 150. The male terminal 110 and the terminal of the electric wire 150 are stored inside the shield shell 130 of this example. Thus, the male housing 120 is formed so that the storage chamber 121*a* of the terminal storage portion 121 and the storage chamber of the terminal holding portion 122 are disposed inside the shield shell 130, and so that the outer tubular circumferential sides of each of the terminal storage section 121 and the terminal holding portion 122 are disposed outside the shield shell 130. In this example, by integrating the male housing 120 and the shield shell 130, the mutual arrangement of the male housing 120 and the shield shell 130 is attained. In the male connector 2, the male housing 120 and the shield shell 130 may be integrated by fitting or the like, or may be integrated by insert molding of the male housing 120 with respect to the shield shell 130.

Here, the shield shell 130 is integrated with the male housing 120 in a state in which at least one of the outer circumferential side and the inner circumferential side of the end portion on the connector insertion direction side is exposed as an annular exposed surface. At least a surface (hereinafter referred to as an "electrical connection surface") 131 physically and electrically connected to the electrical connection surface 31*a* of the shield shell 30 of the female connector 1 is provided as the exposed surface thereof (FIGS. 13 to 15). When the shield shell 130 covers the shield shell 30 from the outside after the connector is fitted, the electrical connection surface 131 is provided on the inner circumferential surface of the shield shell 130. When the shield shell 30 covers the shield shell 130 from the outside after the connector is fitted, the electrical connection surface 131 is provided on the outer circumferential surface of the shield shell 130. In this example, the shield shell 130 and the male housing 120 are inserted into the space S of the female connector 1, and the shield shell 130 covers the shield shell 30 from the outside. Thus, the electrical connection surface 131 is provided on the inner circumferential surface. The electrical connection surface 131 may have an annular wall surface as a contact, or may have a bulged portion bulged from the annular wall surface as a contact. The electrical connection surface 131 of this example has an annular wall surface as a contact.

The male housing 120 of this example is integrated with the shield shell 130 by the insert molding. At the time of the insert molding, a synthetic resin material injected to form the male housing 120 is filled into the inside and the outside of the shield shell 130 via, for example, a through-hole (not illustrated) provided in the shield shell 130. The synthetic resin material filled inside the shield shell 130 constitutes the storage chamber 121*a* side of the terminal storage portion 121 and the storage chamber side of the terminal holding portion 122. Meanwhile, the synthetic resin material filled outside the shield shell 130 constitutes the tubular outer circumferential side of the terminal storage portion 121 and the terminal holding portion 122, respectively.

The male terminal 110 and the electric wire 150 are inserted from the opening side of the end portion of the shield shell 130 on the connector extraction direction side (specifically, the opening at the end portion of the shield shell 130 on the connector extraction direction side). Therefore, the electric wire 150 is pulled out to the outside from the opening of the shield shell 130. The opening is closed with a shield connecting element 160 molded by an insulating material such as a synthetic resin material (FIG. 15). The shield connecting element 160 is made of at least one molded body to be fitted to the opening, and has a through-hole through which the respective electric wires 150 are inserted. Further, the shield connecting element 160 holds a braid 155 made of a conductive material, and physically and electrically connects the braid 155 to the shield shell 30. The braid 155 covers the respective electric wires 150 to suppress entry of noise and is knitted in a tubular and mesh form. A sealing member 170 is disposed on the shield connecting element 160 to suppress the entry of liquid from the side of the shield connecting element 160 toward the inside of the terminal storage portion 121. The sealing member 170 is provided for each electric wire 150.

As described above, in the connector of this embodiment, the shield shell in a state in which a part of the outer circumferential surface or the inner circumferential surface is exposed as the seal side exposed surface is integrated with the housing, and the sealing member is attached on the seal side exposed surface. That is, in the connector of the present embodiment, the sealing member is directly attached to the shield shell, without interposing the synthetic resin layer of the housing stacked on the shield shell as in the conventional case. Therefore, in the connector, it is possible to reduce the size of the body in the direction orthogonal to the tubular axis direction (the connector insertion and extraction direction) at the fitting place with the counterpart connector.

For example, in the above example, in the female connector 1, a part of the outer circumferential surface of the shield shell 30 is exposed as the seal side exposed surface 31, and the sealing member 40 is disposed on the seal side exposed surface 31. Therefore, in the female connector 1, it is possible to reduce the size of the body in the direction orthogonal to the tubular axis direction of the sealing member 40 as compared to the conventional case, and as a result, it is possible to reduce the size of the body of the female housing 20 in the orthogonal direction. Therefore, the female connector 1 can be made smaller in size in the orthogonal direction.

Further, when attaching the sealing member to the inner circumferential side of the shield shell, the conventional connector requires a storage chamber of the minimum size according to the size of the fitting location of the counterpart connector. Thus, it is necessary to increase the size of the body in the direction orthogonal to the tubular axis direction by the amount of the synthetic resin layer of the housing interposed between the shield shell and the sealing member. However, in the connector of this embodiment, a part of the inner circumferential surface of the shield shell is exposed as the seal side exposed surface and the sealing member is attached to the top of the seal side exposed surface. Thus, the necessary minimum size of the storage chamber can be secured, and it is possible to reduce the size of the body in the orthogonal direction.

Furthermore, in the connector (the female connector 1 of this example) of the present embodiment, the shield shell 30 has an annular connecting wall surface 32 which is connected to the seal side exposed surface 31 on the extraction direction side from the counterpart connector (the male connector 2 of this example), and has an annular sealing surface 31*b* with which brings the sealing portion 41 into close contact, an annular facing surface 31*c* on the extraction direction side with respect to the sealing surface 31*b* on the seal side exposed surface 31. In the connector (female connector 1), the sealing member 40 has a tubular connecting portion 42 which is connected to the sealing portion 41 on the extraction direction side and faces at least a part of the facing surface 31*c* of the seal side exposed surface 31 in the circumferential direction. Further, the female housing 20 has the tubular portion 24 that is brought into contact with the connecting wall surface 32 of the shield shell 30 in the circumferential direction. Therefore, in the connector (female connector 1), when the insert molding is used for integrating the inner housing 20B and the shield shell 30, it is possible to bring a part of the insert molding metal die into contact with at least a part of the facing surface 31*c* of the seal side exposed surface 31 in the circumferential direction, without bringing the insert molding metal die into contact with the sealing surface 31*b* on the seal side exposed surface 31. That is, since the connector (female connector 1) has such a configuration, even if the insert molding metal die is not brought into contact with the sealing surface 31*b*, the flow of the synthetic resin material can be suppressed by a part of the insert molding metal die, the inflow of synthetic resin material into the sealing surface 31*b* can be suppressed, and it is possible to suppress a shape deformation of the sealing surface 31*b* caused by the contact of the insert molding metal die. Therefore, since the sealing surface 31*b* having a shape capable of ensuring the sealing property between the connector (female connector 1) and the sealing portion 41 of the sealing member 40 can be provided on the shield shell 30, there is no need for a synthetic resin layer of the housing for securing the sealing property, and the sealing member 40 can be directly attached to the sealing surface 31*b*. Therefore, it is possible to reduce the size of the connector (female connector 1) in a direction orthogonal to the tubular axis direction, while securing the sealing property between the connector and the counterpart connector (male connector 2).

Hereinafter, the insert molding will be briefly described.

Figure 9:
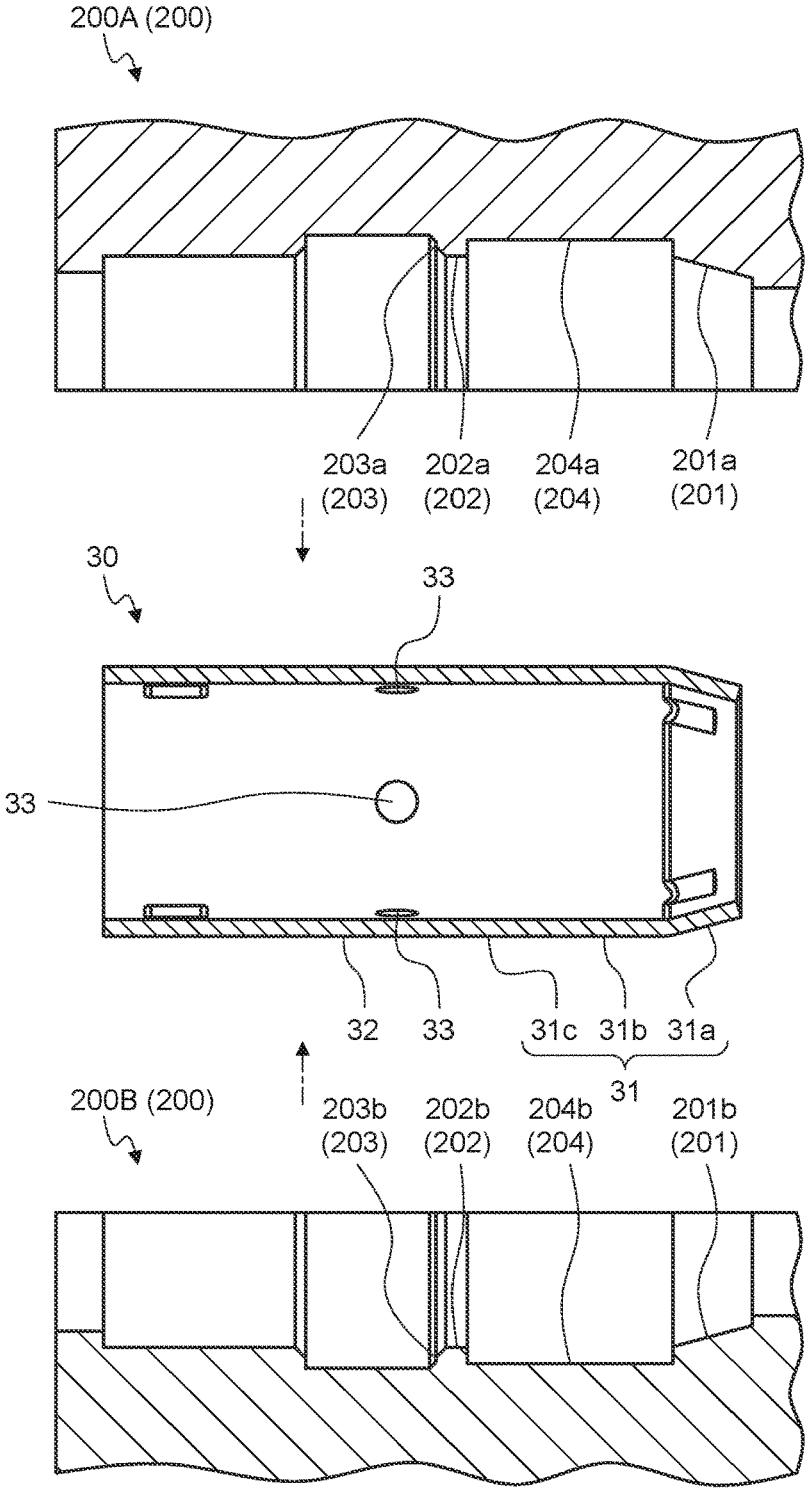
FIG. 9 is a cross-sectional view schematically illustrating an insert molding metal die before being joined with the shield shell.
Figure 10:
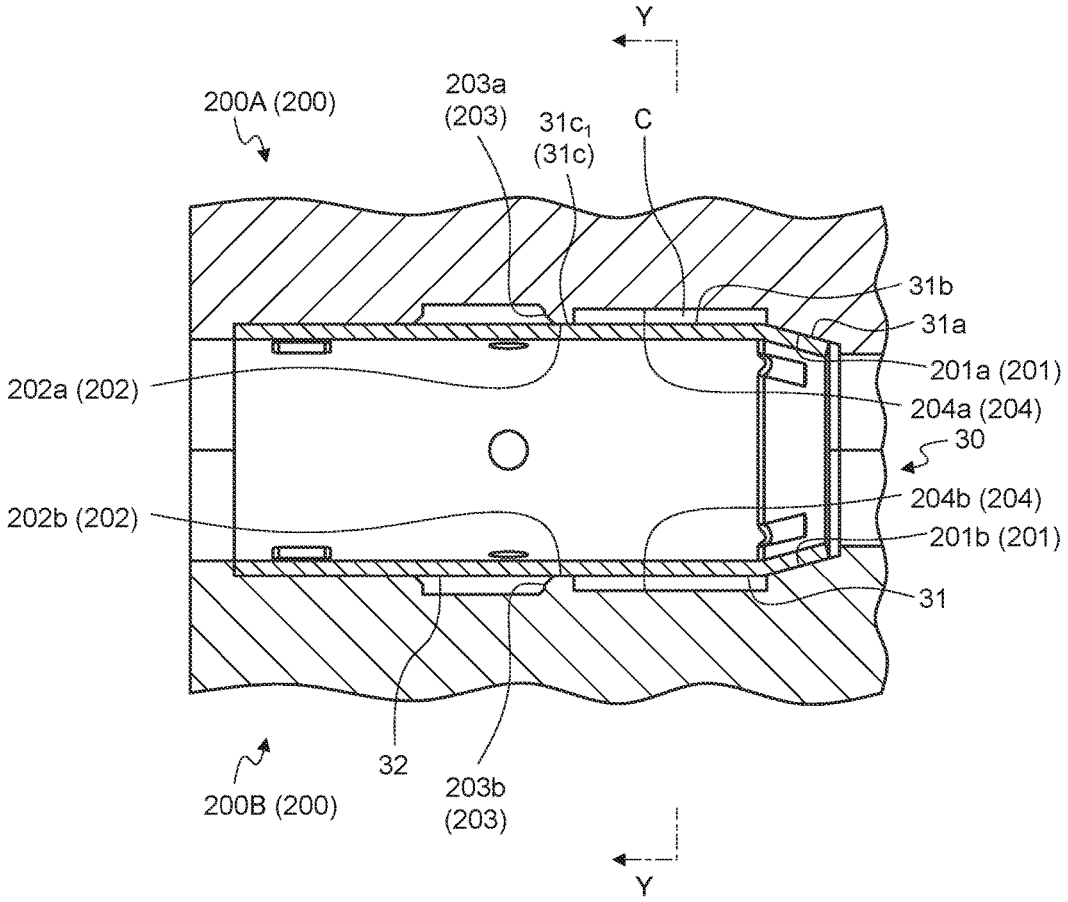
FIG. 10 is a cross-sectional view schematically illustrating an insert molding metal die after being joined with the shield shell.

The female housing 20 is a molded body formed by the insert molding in an insert molding metal die 200 to be described below. FIGS. 9 and 10 illustrate schematic views of the insert molding metal die 200. The insert molding metal die 200 includes a first metal die 200A and a second metal die 200B. One of the first metal die 200A and the second metal die 200B may be a fixed die and the other may be a movable die, and both of them may be a movable die. The type thereof will not be particularly mentioned here. In the insert molding metal die 200, by joining the first metal die 200A and the second metal die 200B, the shield shell 30 is loaded inside the insert molding metal die 200, and by injecting the synthetic resin material into the insert molding metal die 200, the inner housing 20B integrated with the shield shell 30 is formed (FIG. 12). The injected synthetic resin material is filled into the inside and the outside of the shield shell 30, for example, via a through-hole 33 (FIG. 8) provided in the shield shell 30, thereby forming the terminal storage portion 21 and the tubular portion 24.

The insert molding metal die 200 has an annular contact surface that comes into contacts with a part of the seal side exposed surface 31 in the circumferential direction. The insert molding metal die 200 of this example is provided with a first annular contact surface 201 that comes into contact with the electrical connection surface 31*a* on the seal side exposed surface 31 in the circumferential direction at the time of the insert molding, and a second annular contact surface 202 that comes into contact with at least a part 31$c_1$ (FIG. 10) of the facing surface 31*c* of the seal side exposed surface 31 in the circumferential direction at the time of the insert molding (FIGS. 9 and 10). In the first annular contact surface 201, when the first metal die 200A and the second metal die 200B are joined together, a semi-annular contact surface (hereinafter, referred to as a "semi-annular contact surface") 201*a* provided in the first metal die 200A, and a semi-annular contact surface 201*b* provided in the second metal die 200B are combined and are formed as a single annular wall surface. Further, in the second annular contact surface 202, when the first metal die 200A and the second metal die 200B are joined together, a semi-annular contact surface 202*a* provided on the first metal die 200A and a semi-annular contact surface 202*b* provided on the second metal die 200B are combined and are formed as a single annular wall surface.

In the female connector 1, since the inflow of the synthetic resin material into the electrical connection surface 31*a* at the time of insert molding is suppressed by the first annular contact surface 201, the contact portion of the male connector 2 with the electrical connection surface 131 of the shield shell 130 is secured. Further, in the female connector 1, since the flow of the synthetic resin material is stopped at the time of the insert molding by the second annular contact surface 202, it is possible to suppress the inflow of the synthetic resin material into the sealing surface 31*b*.

Furthermore, the insert molding metal die 200 has an annular wall surface 203 connected to the second annular contact surface 202. The annular wall surface 203 is connected to the second annular contact surface 202 on the connector extraction direction side, in a non-contact state to the connecting wall surface 32 of the shield shell 30. When the first metal die 200A and the second metal die 200B are joined together, in the annular wall surface 203, a semi-annular wall surface 203*a* provided in the first metal die 200A and a semi-annular wall surface 203*b* provided in the second metal die 200B are combined and are formed as a single annular wall surface. The annular wall surface 203 of this example is formed into a tapered shape. By stopping the injected synthetic resin material, the annular wall surface 203 forms an annular end surface 24*a* of the tubular portion 24 of the inner housing 20B on the connector insertion and extraction direction side (FIG. 12).

Figure 11:
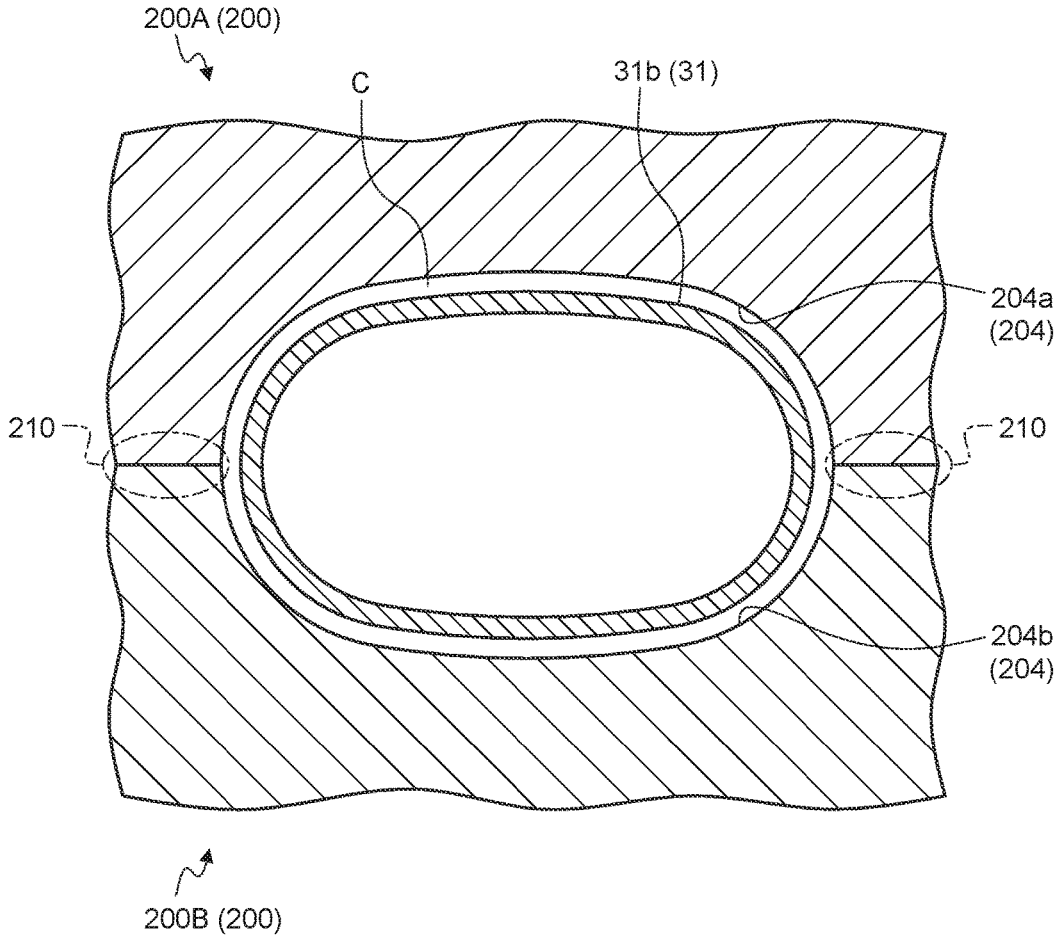
FIG. 11 is a view corresponding to a cross-sectional view taken along the line Y-Y of FIG. 10.

Further, in the insert molding metal die 200, a cavity C is interposed between at least a joining portion 210 between the metal dies in the first metal die 200A and the second metal die 200B, and the sealing surface 31*b* on the seal side exposed surface 31 (FIG. 11). Thus, in the female connector 1, when the first metal die 200A and the second metal die 200B are joined together, it is possible to suppress the biting of the sealing surface 31*b* in the joining portion 210 or the rubbing against the sealing surface 31*b*. Therefore, since the female connector 1 is insert-molded by the insert molding metal die 200 having such a cavity C, the shape deformation of the sealing surface 31*b* in the vicinity of the joining portion 210 of the insert molding metal die 200 is suppressed. Accordingly, it is possible to suppress the deterioration of the sealing property between the female connector and the sealing portion 41 of the sealing member 40.

Specifically, the insert molding metal die 200 of this example has an annular non-contact surface (hereinafter, referred to as an "annular non-contact surface") 204 spaced apart from the sealing surface 31*b* in the circumferential direction, and an annular cavity C is interposed between the annular non-contact surface 204 and the sealing surface 31*b*. When the first metal die 200A and the second metal die 200B are joined together, in the annular non-contact surface 204, the semi-annular non-contact surface 204*a* provided on the first metal die 200A and the semi-annular non-contact surface 204*b* provided on the second metal die 200B are combined and are formed as a single annular wall surface. In the female connector 1, since such an annular cavity C is provided at the time of insert molding, the shape deformation of the sealing surface 31*b* in the vicinity of the joining portion 210 is suppressed as described above. Accordingly, it is possible to suppress the deterioration of the sealing property between the sealing surface 31*b* and the sealing portion 41 of the sealing member 40. Further, in the female connector 1, since the annular cavity C is provided at the time of insert molding, the pressing force does not act on the sealing surface 31*b* from the first metal die 200A and the second metal die 200B. Accordingly, it is possible to suppress the shape deformation of the sealing surface 31*b* caused by such pressing force. Therefore, the female connector 1 can suppress the deterioration of the sealing property between the sealing surface 31*b* and the sealing portion 41 of the sealing member 40 over the entire circumference of the sealing surface 31*b*.

In the connector according to the embodiments, the shield shell in a state in which a part of the outer circumferential surface or the inner circumferential surface is exposed as the seal side exposed surface is integrated with the housing, and the sealing member is mounted on the seal side exposed surface. That is, in the connector, the sealing member is directly attached to the shield shell, without interposing a synthetic resin layer of the housing stacked on the shield shell as in the conventional case. Therefore, in the connector, it is possible to reduce the size of the body in the direction orthogonal to the tubular axis direction (connector insertion and extraction direction) at the fitting location between the connector and the counterpart connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal to which each of an electric wire and a counterpart terminal of a counterpart connector is electrically connected;

a housing which is made of a synthetic resin material and holds the terminal on an inner side thereof;

a shield shell which is a tubular conductive member in which a tubular axis direction is made to match a connector insertion and extraction direction and both ends are opened, the shield shell being integrated with the housing in a state in which at least one of an outer circumferential side and an inner circumferential side of an end portion on an insertion direction side to the counterpart connector is exposed as an annular exposed surface, and the terminal and/or the electric wire being disposed inside the shield shell; and a sealing member which has a tubular sealing portion interposed between a counterpart housing or a counterpart shield shell of the fitted counterpart connector and the exposed surface as a seal side exposed surface opposite to the counterpart housing or the counterpart shield shell, and suppresses entry of liquid therebetween by the sealing member, wherein the shield shell has an annular connecting wall surface connected to the seal side exposed surface on an extraction direction side from the counterpart connector, and has an annular sealing surface into which the sealing portion is brought into close contact, and an annular facing surface on the extraction direction side to the sealing surface, on the seal side exposed surface, the sealing member has a tubular connecting portion which is connected to the sealing portion on the extraction direction side and faces at least a part of the facing surface in a circumferential direction, and the housing has a tubular portion that is brought into contact with the connecting wall surface in the circumferential direction.

2. The connector according to claim 1, wherein the housing has a holding portion which holds the sealing member and performs positioning on the seal side exposed surface of the sealing member, on a side of the tubular portion orthogonal to the tubular axis direction, and on a wall surface opposite to a wall surface facing the connecting wall surface of the shield shell, and the sealing member has a holding target portion which is connected to the connecting portion on the extraction direction side and is held by the holding portion.

3. The connector according to claim 2, wherein when the shield shell has the seal side exposed surface on the outer circumferential surface side, the housing is a molded body which is insert-molded with an insert molding metal die having an annular contact surface which comes into contact with at least a part of the facing surface of the shield shell in the circumferential direction, and interposing a cavity between the sealing surface and at least a joining portion of the insert molding metal die, and, the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

4. The connector according to claim 2, wherein when the shield shell has the seal side exposed surface on the outer circumferential surface side, the housing is a molded body which is insert-molded with an insert molding metal die which has an annular contact surface which comes into contact with at least a part of the facing surface of the shield shell in the circumferential direction and an annular non-contact surface which is spaced apart from the sealing surface in the circumferential direction, and in which an annular cavity is interposed between the annular non-contact surface and the sealing surface, and the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

5. The connector according to claim 1, wherein when the shield shell has the seal side exposed surface on the outer circumferential surface side, the housing is a molded body which is insert-molded with an insert molding metal die having an annular contact surface which comes into contact with at least a part of the facing surface of the shield shell in the circumferential direction, and interposing a cavity between the sealing surface and at least a joining portion of the insert molding metal die, and, the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

6. The connector according to claim 1, wherein when the shield shell has the seal side exposed surface on the outer circumferential surface side, the housing is a molded body which is insert-molded with an insert molding metal die which has an annular contact surface which comes into contact with at least a part of the facing surface of the shield shell in the circumferential direction and an annular non-contact surface which is spaced apart from the sealing surface in the circumferential direction, and in which an annular cavity is interposed between the annular non-contact surface and the sealing surface, and the tubular portion of the housing has an annular end surface which comes into contact with an annular wall surface of the insert molding metal die which is connected to the annular contact surface on the extraction direction side and in a non-contact state to the connecting wall surface at a time of insert molding, on the insertion direction side.

* * * * *